US009132530B2

(12) United States Patent
Lin

(10) Patent No.: US 9,132,530 B2
(45) Date of Patent: Sep. 15, 2015

(54) KNIFE SHARPENING DEVICE

(71) Applicant: Kuo-Pin Lin, Tainan (TW)

(72) Inventor: Kuo-Pin Lin, Tainan (TW)

( * ) Notice: Subject to any disclaimer, the term of this patent is extended or adjusted under 35 U.S.C. 154(b) by 75 days.

(21) Appl. No.: 14/105,229

(22) Filed: Dec. 13, 2013

(65) Prior Publication Data

US 2015/0165593 A1 Jun. 18, 2015

(51) Int. Cl.

| | |
|---|---|
| ***B24B 41/06*** | (2012.01) |
| ***B24D 15/08*** | (2006.01) |
| ***B24B 3/54*** | (2006.01) |

(52) U.S. Cl.

CPC ..... *B24D 15/081* (2013.01); *B24B 3/54* (2013.01); *B24B 41/065* (2013.01)

(58) Field of Classification Search

CPC ..... B24B 3/52; B24B 3/54; B24B 41/065; B24D 15/063; B24D 15/065; B24D 15/08; B24D 15/081

See application file for complete search history.

(56) References Cited

U.S. PATENT DOCUMENTS

| | | | | |
|---|---|---|---|---|
| 2,398,711 A * | 4/1946 | Lambert | ..... | 451/486 |
| 2,709,379 A * | 5/1955 | Murchison | ..... | 76/86 |
| 5,620,359 A * | 4/1997 | Harrison et al. | ..... | 451/45 |

* cited by examiner

*Primary Examiner* — Timothy V Eley

(74) *Attorney, Agent, or Firm* — Alan D. Kamrath; Kamrath IP Lawfirm, P.A.

(57) ABSTRACT

A knife sharpening device contains: a main whetstone portion and a sub whetstone portion. The main whetstone portion includes a bevel seat, two stopping protrusions, at least one first support piece, at least one second support piece, and a main sharpening block. The bevel seat has a tilted face, the at least one first support piece, the at least one second support piece, the main sharpening block, and the sub whetstone portion. The sub whetstone portion includes at least one sub sharpening block, an auxiliary sharpening face, and a concave wall. Each sub sharpening block has the auxiliary sharpening face defined on a front surface thereof and corresponding to the main sharpening block of the main whetstone portion, and the concave wall is defined below the auxiliary sharpening face.

10 Claims, 13 Drawing Sheets

KNIFE SHARPENING DEVICE

FIELD OF THE INVENTION

The present invention relates to a knife sharpening device which sharpens a knife easily and precisely.

BACKGROUND OF THE INVENTION

A knife is sharpened by a whetstone or a wheeled knife sharpening device. However, a user cannot control a sharpening angle and an operating force exactly if using the whetstone to sharpen a knife, and the user will be hurt easily.

The wheeled knife sharpening device contains at least one grinding wheel and a recess for placing a knife and corresponding to the at least one grinding wheel, such that the at least one grinding wheel sharpens the knife. Nevertheless, the wheeled knife sharpening device cannot sharpen the knife sharply after a period of using time.

The present invention has arisen to mitigate and/or obviate the afore-described disadvantages.

SUMMARY OF THE INVENTION

The primary object of the present invention is to provide a knife sharpening device which sharpens a knife sharpened easily and precisely by using a sharpening space and an oblique gap so as to form a sharp blade tip, and prevents the knife being sharpened excessively.

DETAILED DESCRIPTION OF THE PREFERRED EMBODIMENTS

Figure 1:
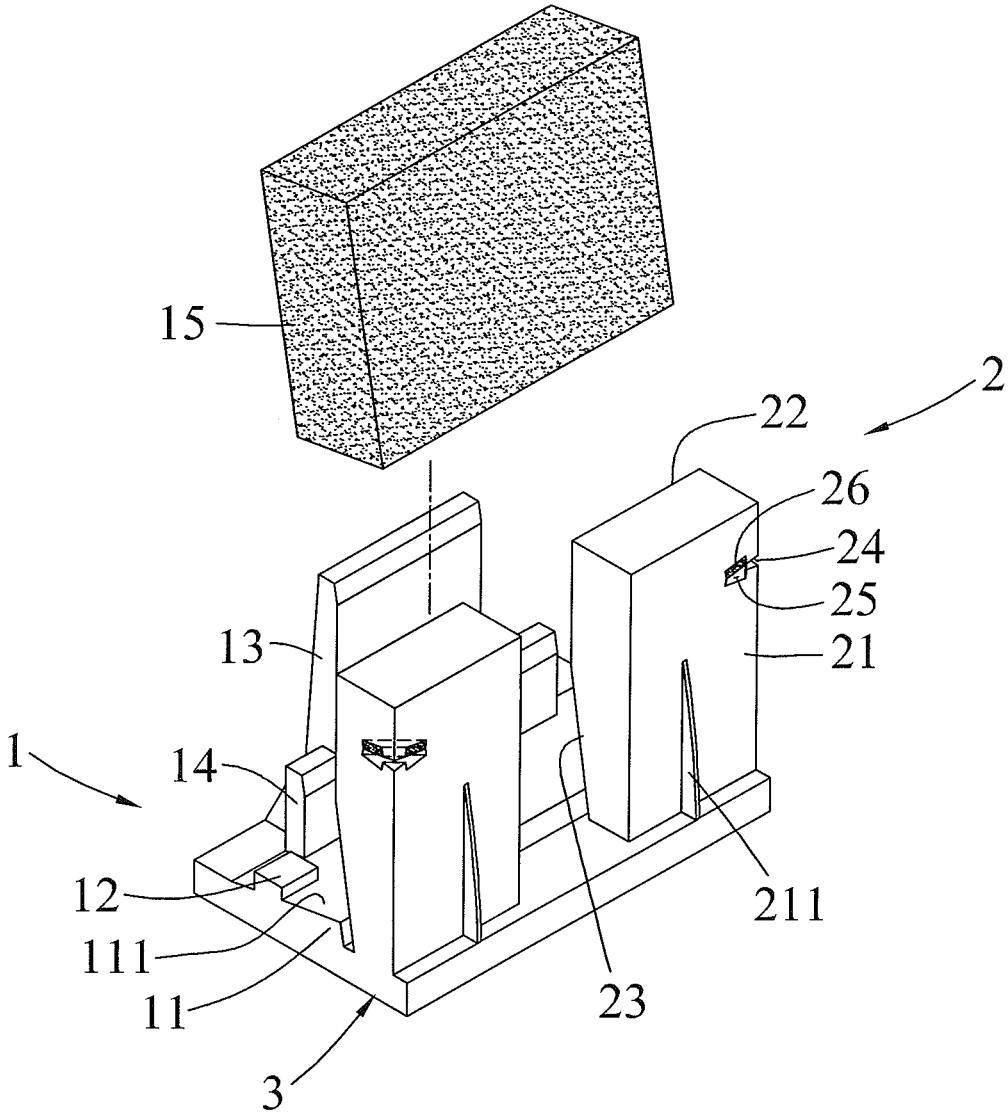
FIG. 1 is a perspective view showing the assembly of a knife sharpening device according to a preferred embodiment of the present invention.
Figure 2:
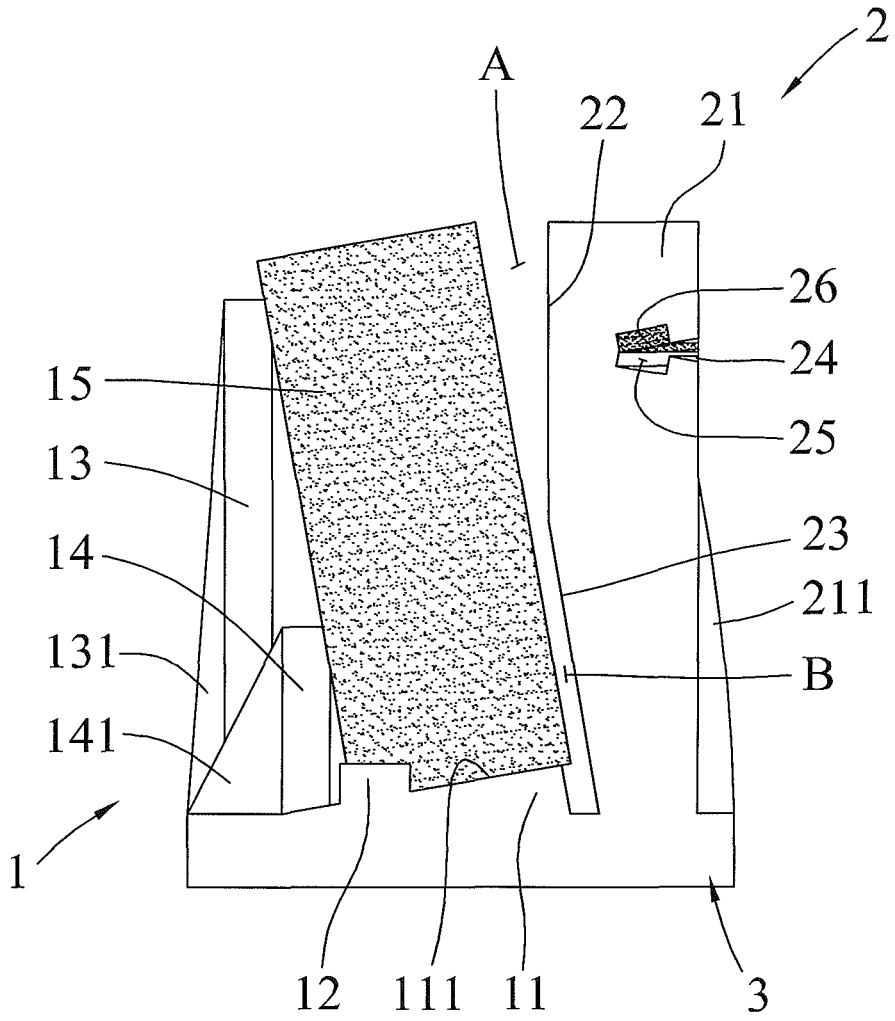
FIG. 2 is a plan view showing the assembly of the knife sharpening device according to the preferred embodiment of the present invention.

With reference to FIG. 1, a knife sharpening device according to a preferred embodiment of the present invention comprises: a main whetstone portion 1 and a sub whetstone portion 2.

The main whetstone portion 1 includes a bevel seat 11, two stopping protrusions 12, at least one first support piece 13, at least one second support piece 14, and a main sharpening block 15. The bevel seat 11 is triangularly formed on a bottom end of the main whetstone portion 1 and has a tilted face 111 defined thereon, and an angle between the tilted face 111 and the bottom end of the main whetstone portion 1 is 10 degrees or 15 degrees, the bevel seat 11 also has two stopping protrusions 12 disposed on two sides thereof, the at least one first support piece 13 and the at least one second support piece 14 which are mounted on a first side of the bevel seat 11 proximate to a lower side of the tilted face 111, wherein the at least one first support piece 13 is higher than the at least one second support piece 14, the bevel seat 11 further has the main sharpening block 15 accommodated thereon, wherein a whetstone number of the main sharpening block 15 is 80 to 1000, and a bottom end of the main sharpening block 15 contacts with the tilted face 111, such that the main sharpening block 15 is tilted so as to cooperate with the tilted face 111 and its two ends are stopped by the two stopping protrusions 12, wherein one side surface of the main sharpening block 15 contacts with the at least one first support piece 13 and the at least one second support piece 14, each of the at least one first support piece 13 has a first rib 131 formed on a back surface thereof, and each of the at least one second support piece 14 has a second rib 141 formed on a back surface thereof, such that each of the at least one first support piece 13 and each of the at least one second support piece 14 are reinforced by the first rib 131 and the second rib 141 so as to support the main sharpening block 15. The bevel seat 11 further has the sub whetstone portion 2 secured on a second side thereof proximate to a higher side of the tilted face 111.

The sub whetstone portion 2 includes at least one sub sharpening block 21, an auxiliary sharpening face 22, a concave wall 23, a recess 24, a notch 25, and a micro-sharpening face 26. Each sub sharpening block 21 has the auxiliary sharpening face 22 defined on a front surface thereof and corresponding to the main sharpening block 15 of the main whetstone portion 1, the concave wall 23 is defined below the auxiliary sharpening face 22 and becomes concaved inwardly from the auxiliary sharpening face 22 so as to match with a tilted angle of the main sharpening block 15. Each sub sharpening block 21 also has the recess 24 formed on an edge of a back surface thereof and in a V shape, and the recess 24 has the notch 25 defined on a bottom end thereof and a predetermined angle slanting upwardly, and the predetermined angle is 20 degrees. The recess 24 also has the micro-sharpening face 26 arranged on an upper side of an inner wall thereof, wherein a whetstone number of the micro-sharpening face 26 is 1000 to 3000, and each sub sharpening block 21 further has a third rib 211 formed on the back surface thereof so as to reinforce each sharpening block 21.

Figure 3:
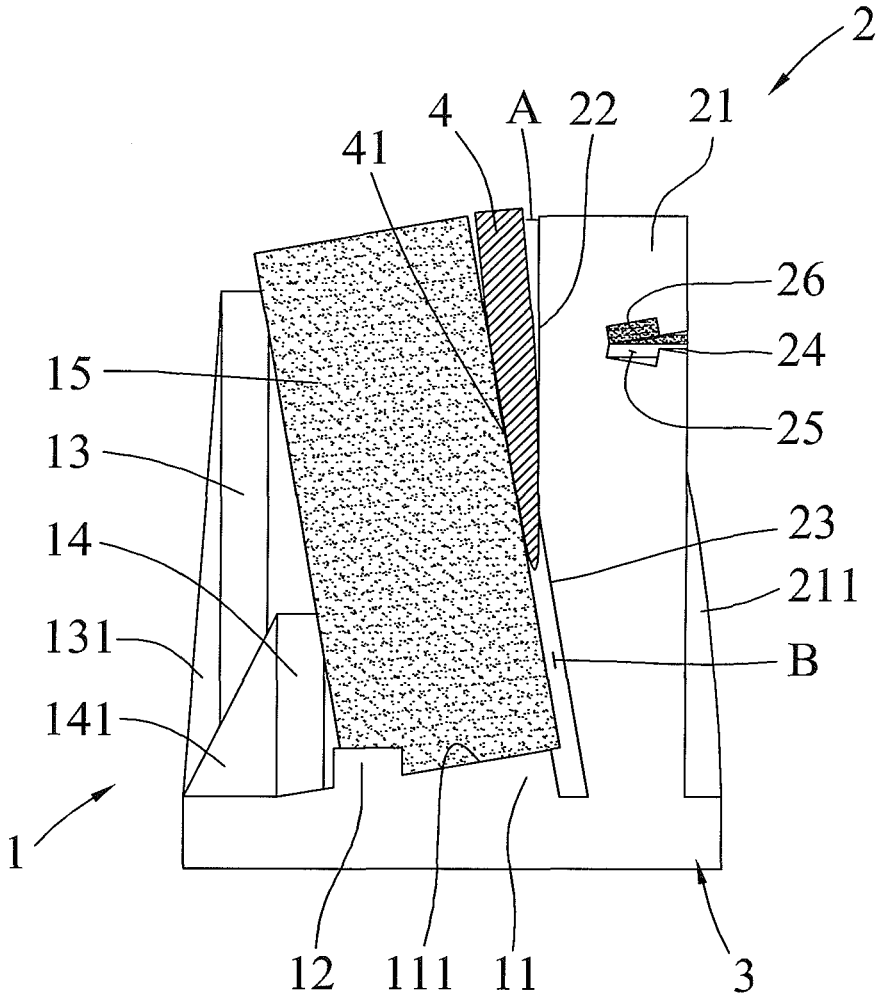
FIG. 3 is a cross sectional view showing the operation of the knife sharpening device according to the preferred embodiment of the present invention.

Thereby, the main whetstone portion 1 and the sub whetstone portion 2 are disposed on a base 3, and a higher side of the bottom end of the main sharpening block 15 contacts with the concave wall 23 and is over the auxiliary sharpening face 22, such that a downwardly extending line of the auxiliary sharpening face 22 intersects with the main sharpening block 15, hence a sharpening space A is defined between the main sharpening block 15 and each sub sharpening block 21, a minimum distance of the sharpening space A is 1.1 mm, and between the main sharpening block 15 and the concave wall 23 is defined an oblique gap B which extends toward a bottom end of each sub sharpening block 21 and communicates with the sharpening space A (as illustrated in FIG. 3), such that a knife 4 is placed into the sharpening space A, and since a bottom end of the sharpening space A communicates with the oblique gap B, a tip portion of a bottom end of the knife 4 suspends in the oblique gap B.

Figure 4:
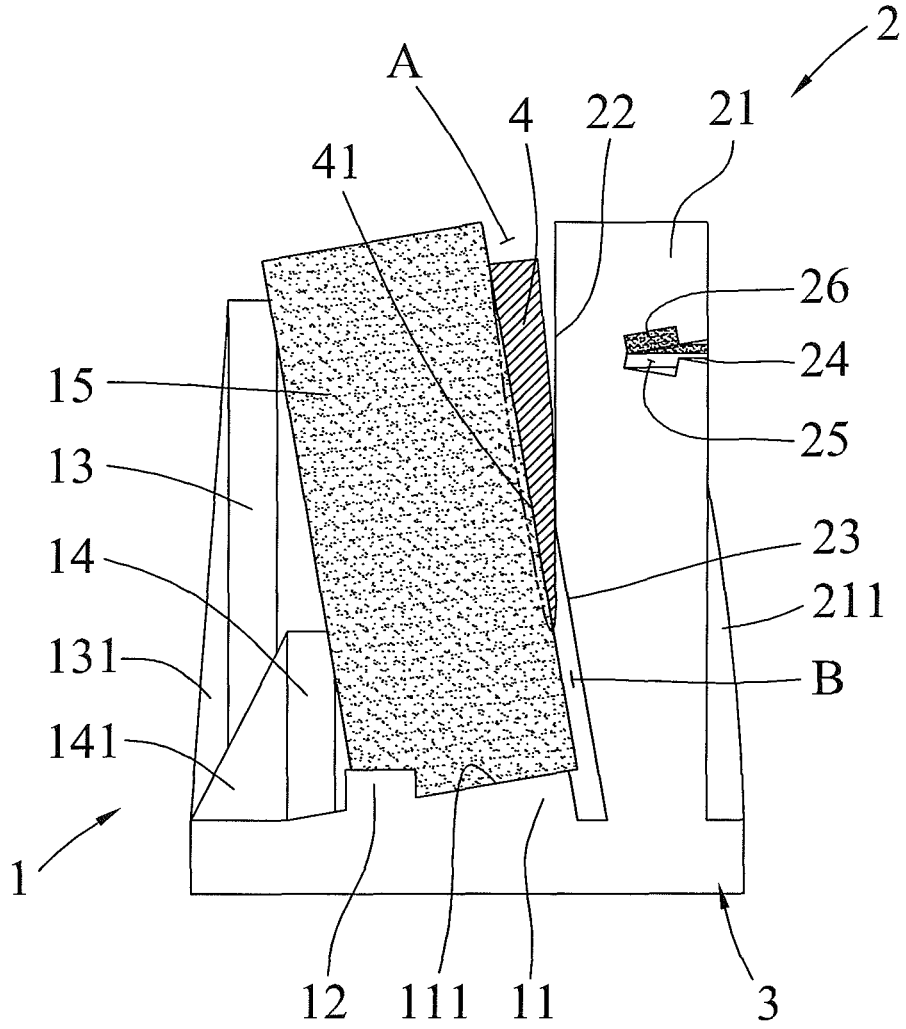
FIG. 4 is another cross sectional view showing the operation of the knife sharpening device according to the preferred embodiment of the present invention.
Figure 5:
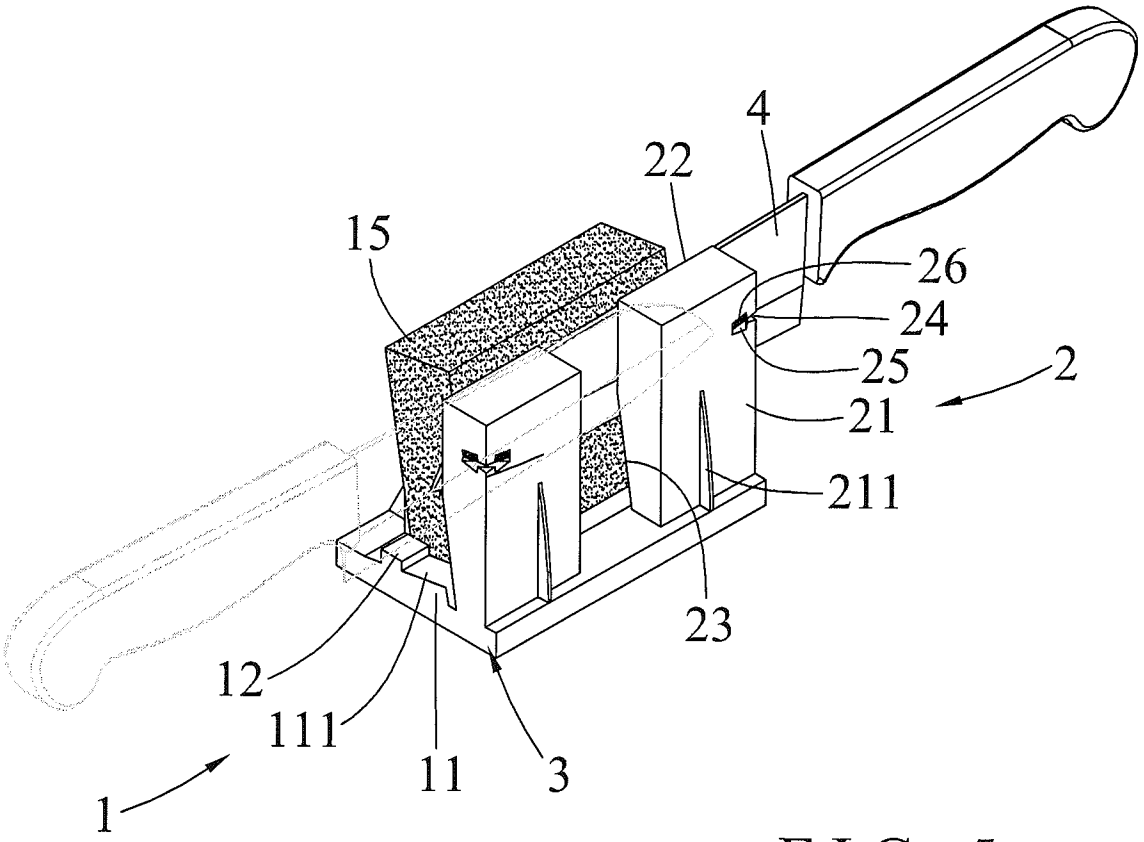
FIG. 5 is a perspective view showing the operation of the knife sharpening device according to the preferred embodiment of the present invention.

Referring to FIG. 3, the main whetstone portion 1 includes one first support piece 13 and two second support pieces 14, and the two second support pieces 14 are arranged on two ends of the first support piece 13, the sub whetstone portion 2 includes two sub sharpening blocks 21, such that the main sharpening block 15 flatly sharpens a blade 41 of the knife 4. In operation, the knife 4 is placed into the sharpening space A, and two sides of the blade 41 of the knife 4 contact with the main sharpening block 15 and the auxiliary sharpening face 22 by ways of the oblique gap B so as to be sharpened by the main sharpening block 15. In addition, the auxiliary sharpening face 22 supports and positions the knife 4 in the sharpening space A. As shown in FIG. 4, a first surface of the knife 4 is sharpened repeatedly in the sharpening space A, and the first surface of the blade 41 contacts with and is sharpened by the main sharpening block 15, thus sharpening the knife 4. With reference to FIG. 5, as desiring to sharpen a second surface of the knife 4, the knife 4 is changed to another direction so that the second surface of the knife 4 contacts with and is sharpened by the main sharpening block 15.

Figure 6:
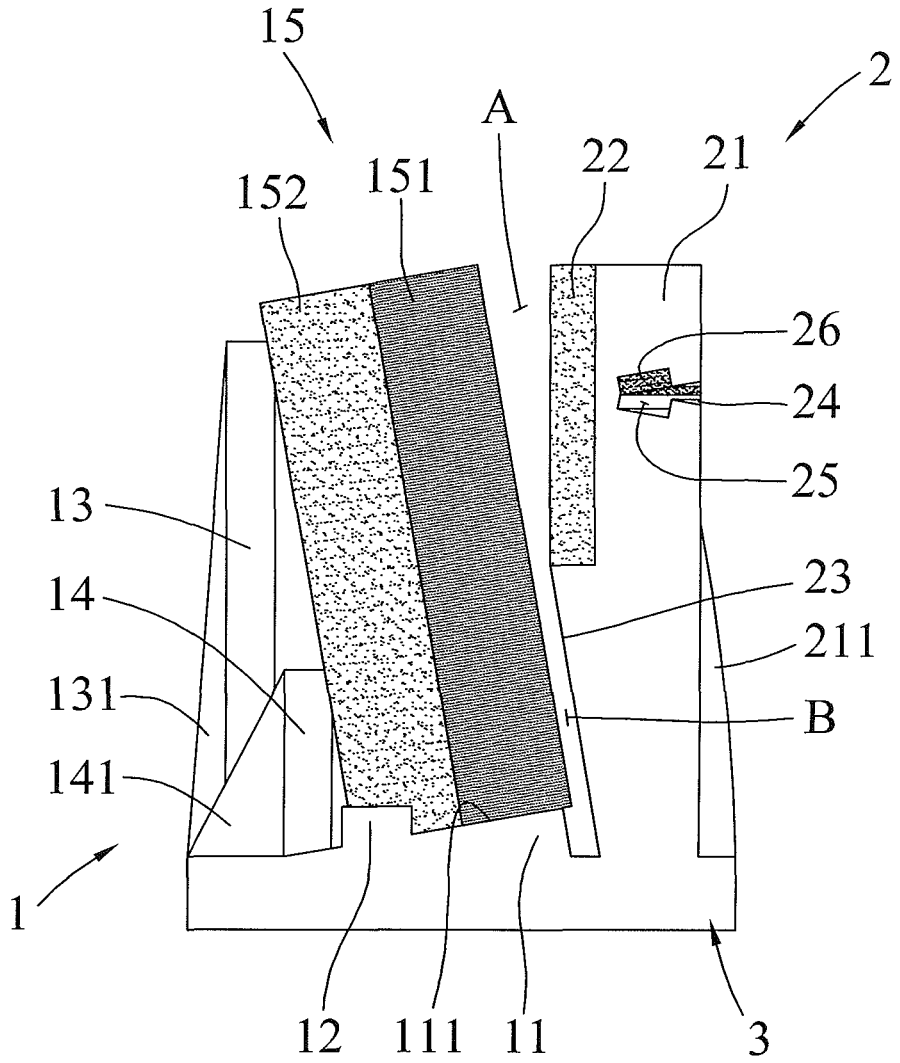
FIG. 6 is a plan view showing the assembly of a knife sharpening device according to another preferred embodiment of the present invention.

Referring to FIG. 6, the main sharpening block 15 of the main whetstone portion 1 has a first sharpening face 151 and a second sharpening face 152, and a whetstone number of each of the first sharpening face 151 and the second sharpening face 152 is 80 to 1000, such that the whetstone number of the main sharpening block 15 can be changed conveniently, hence the knife can be sharpened at a varying coarseness. The auxiliary sharpening face 22 of the sub whetstone portion 2 can be a whetstone surface, and a whetstone number of the auxiliary sharpening face 22 is 400 to 1000, such that when the main sharpening block 15 sharpens the knife 4, the auxiliary sharpening face 22 sharpens a part of the knife which contacts with the auxiliary sharpening face 22 so as to sharpen or polish and to support the knife 4 auxiliarily.

Figure 7:
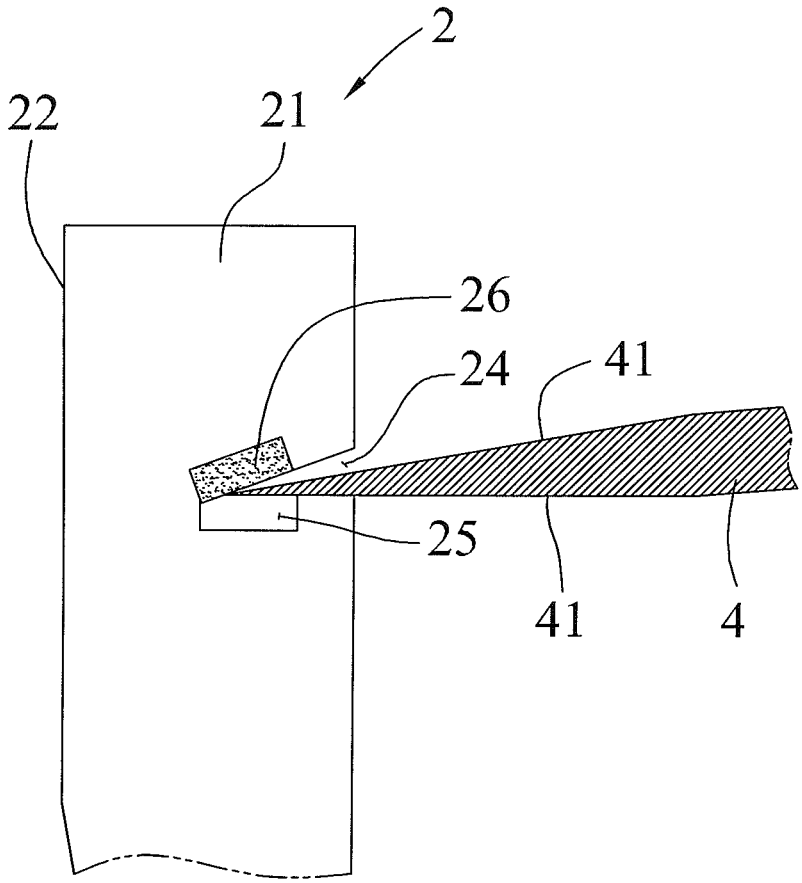
FIG. 7 is a cross sectional view showing the operation of the knife sharpening device according to another preferred embodiment of the present invention.
Figure 8:
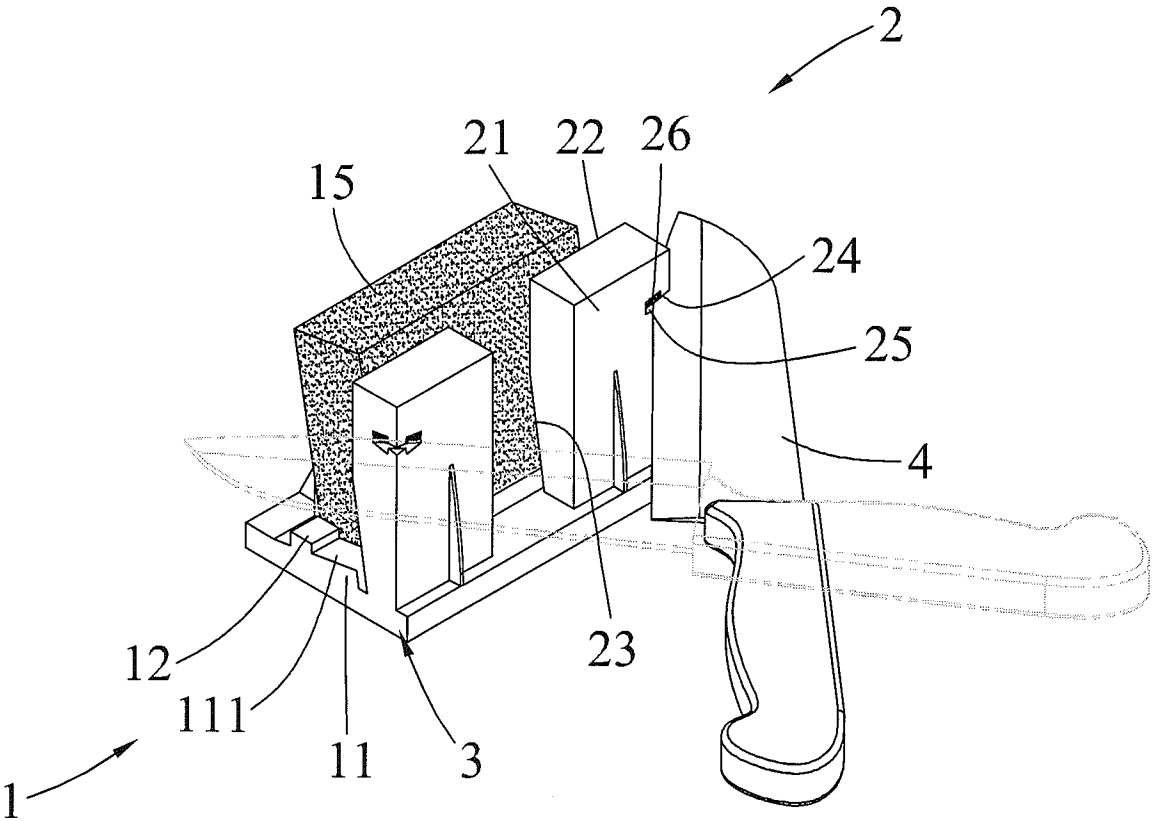
FIG. 8 is a perspective view showing the operation of the knife sharpening device according to another preferred embodiment of the present invention.
Figure 9:
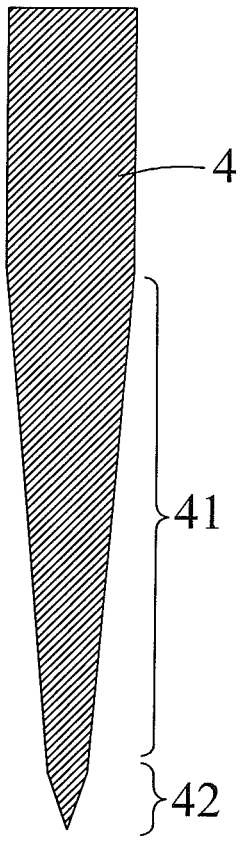
FIG. 9 is another cross sectional view showing the operation of the knife sharpening device according to another preferred embodiment of the present invention.

As shown in FIGS. 7 and 9, as intending to sharpen a blade tip 42 of the knife 4 by means of the recess 24 of the sub whetstone portion 2, the knife 4 is placed into the recess 24, and the blade tip 42 of the knife 4 contacts with the micro-sharpening face 26 so that the knife 4 scratches along the recess 24 repeatedly, hence the blade tip 42 of the knife 4 is sharpened by the micro-sharpening face 26. As illustrated in FIG. 5, as desiring to sharpen the second surface of the knife 8, the knife 4 is changed to another direction so that the second surface of the knife 4 contacts with and is sharpened by the micro-sharpening face 26.

With reference to FIG. 9, the blade tip 42 of the knife 4 is sharpened so as to increase strength of the blade 41 and to remove burrs of the blade 41.

Figure 10:
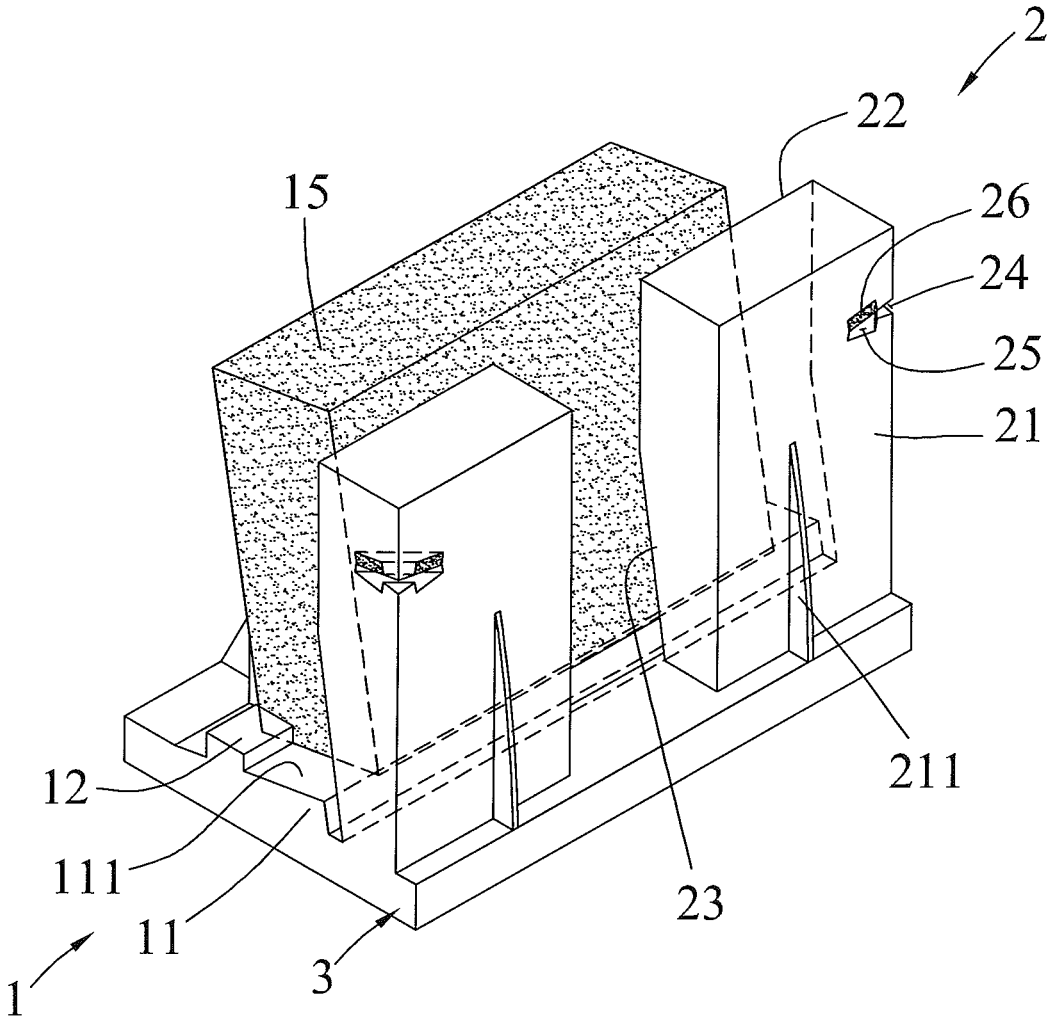
FIG. 10 is another perspective view showing the operation of the knife sharpening device according to another preferred embodiment of the present invention.
Figure 11:
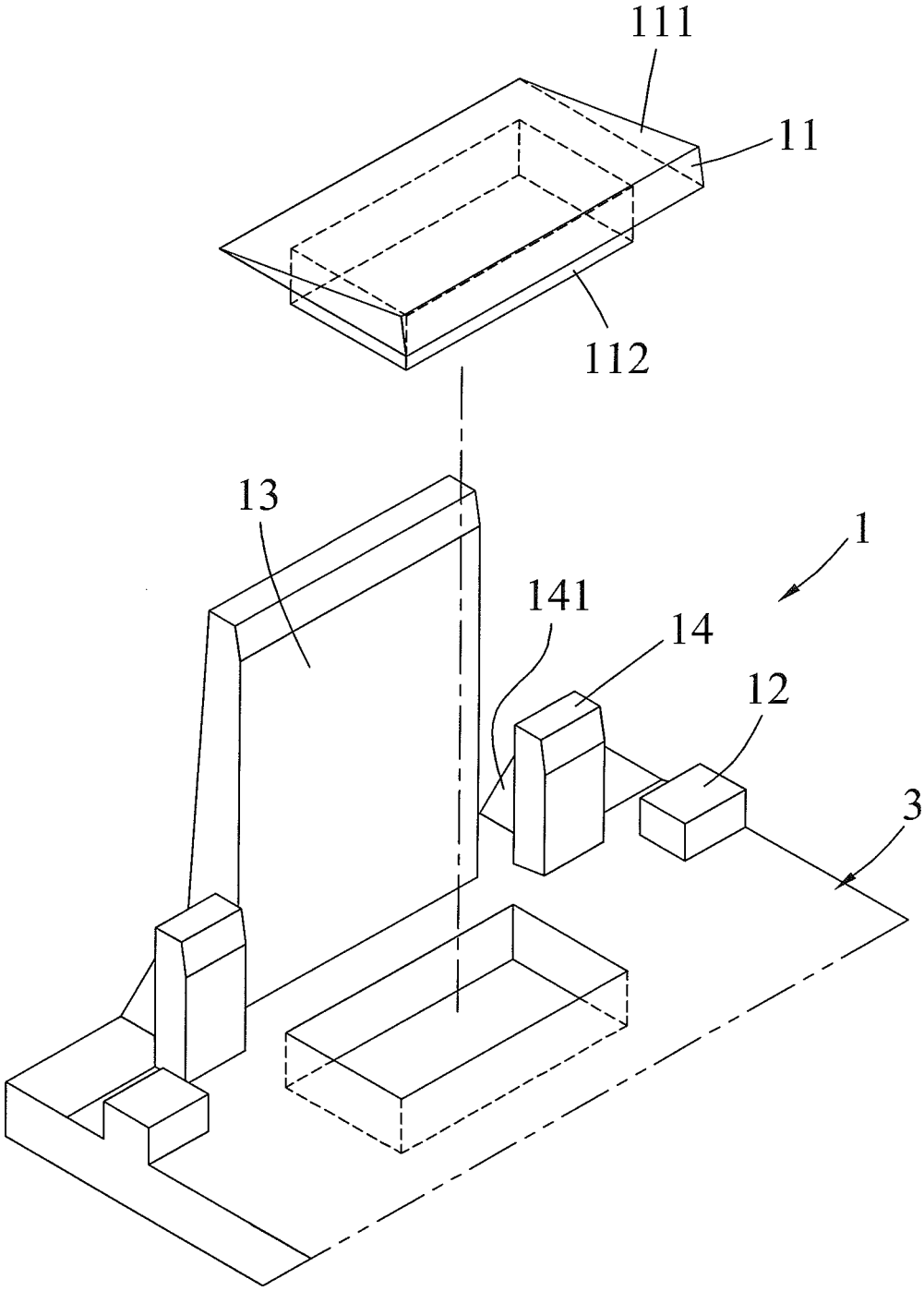
FIG. 11 is a perspective view showing the assembly of a part of a bevel seat of the knife sharpening device according to another preferred embodiment of the present invention.
Figure 12:
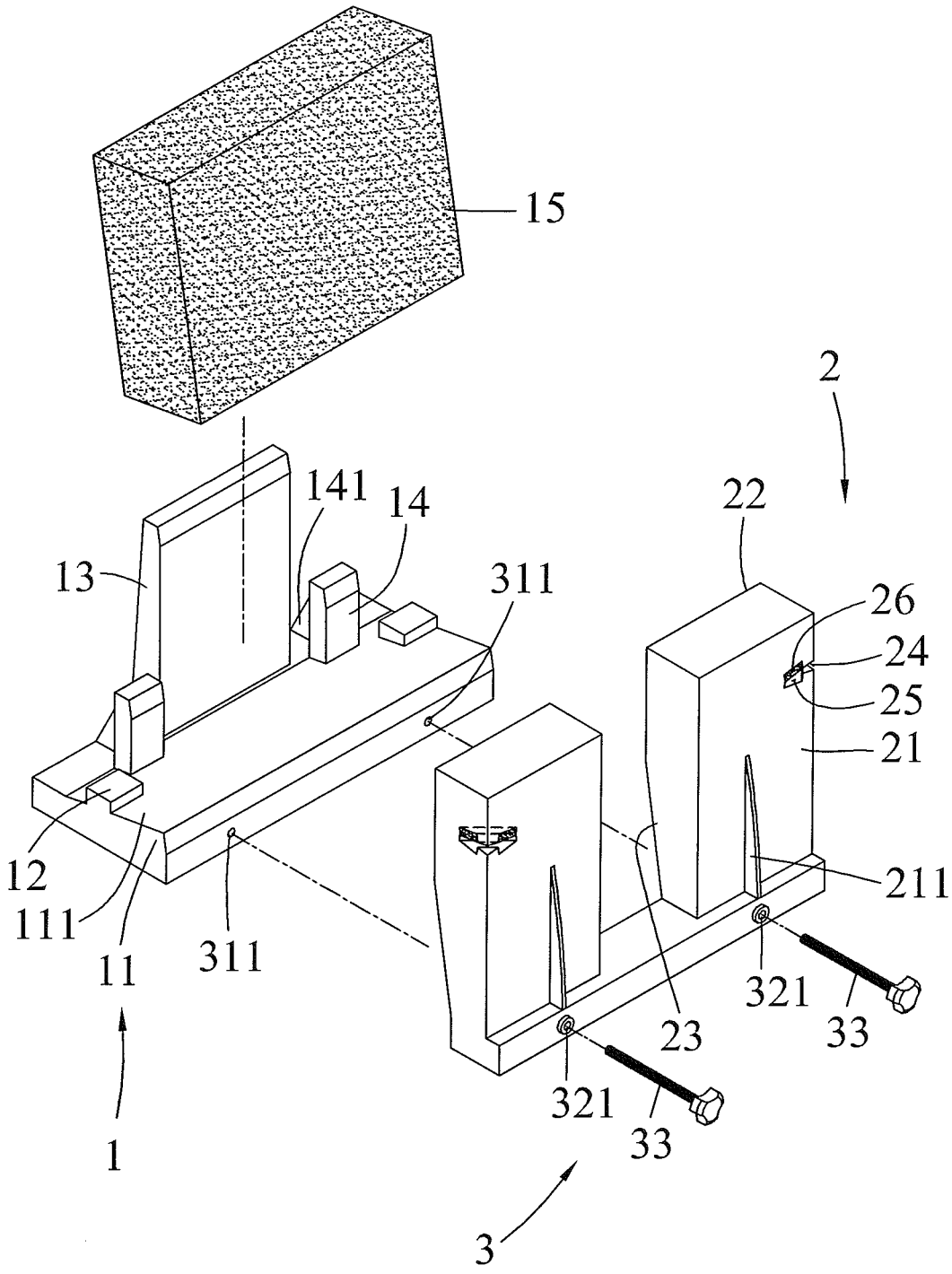
FIG. 12 is a perspective view showing the assembly of a base of the knife sharpening device according to the preferred embodiment of the present invention.

Referring to FIG. 10, the main whetstone portion 1 and the sub whetstone portion 2 are disposed on the base 3, and the bevel seat 11, the two stopping protrusions 12, the at least one first support piece 13, the at least one second support piece 14, and the at least one sub sharpening block 21 of the sub whetstone portion 2 are one piece formed with the base 3. For example, as shown in FIG. 11, the bevel seat 11 is replaceable so as to switch 10 degree of angle or 15 degree of angle, wherein the bevel seat 11 also has a connecting projection 112 arranged on a bottom end thereof and retaining with the base 3.

Figure 13:
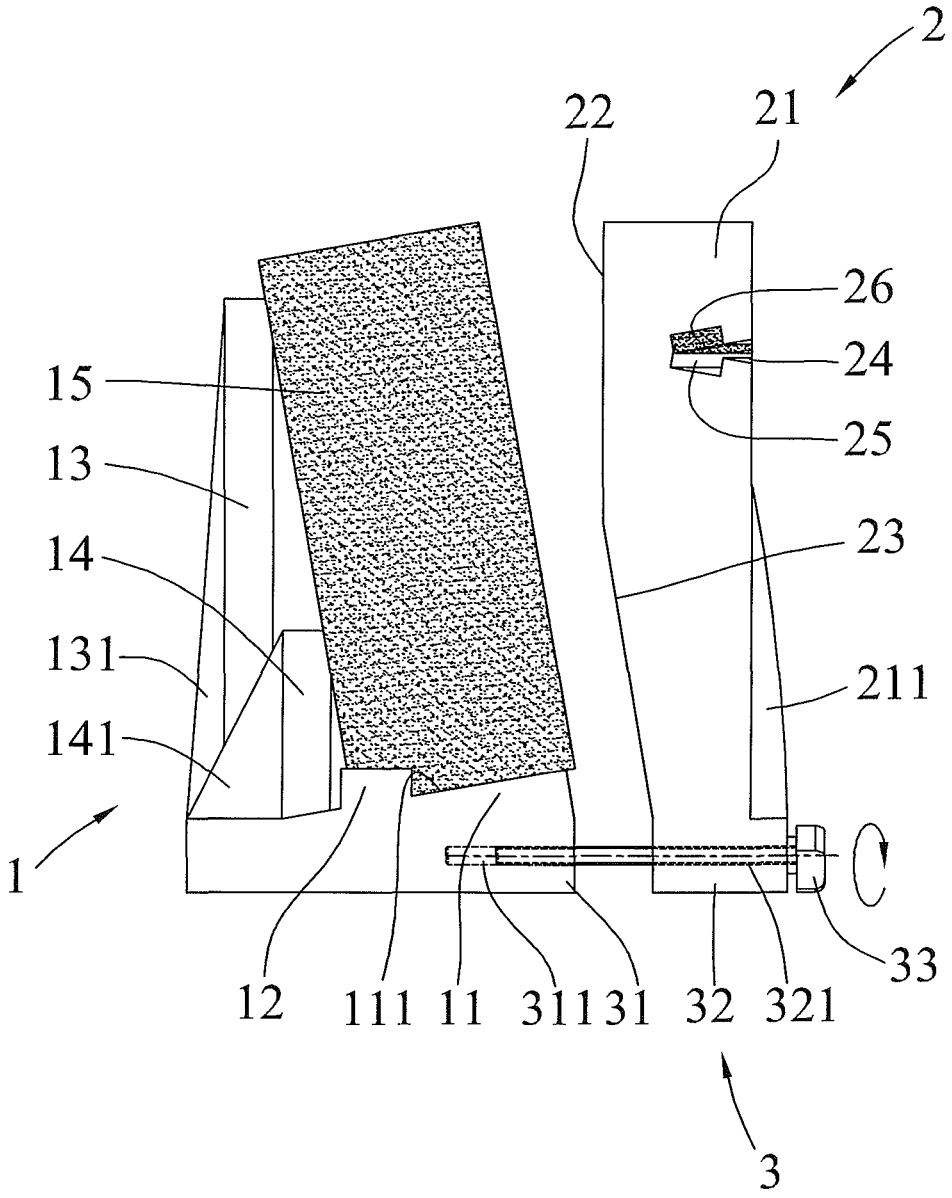
FIG. 13 is a plan view showing the assembly of the base of the knife sharpening device according to the preferred embodiment of the present invention.

As illustrated in FIG. 13, the base 3 includes a first part 31 and a second part 32, and the first part 31 has the main whetstone portion 1 disposed thereon, the second part 32 has the sub whetstone portion 2 mounted thereon, the first part 31 has at least one first adjusting orifice 311 defined thereon and corresponding to the second part 32, the second part 32 has at least one second adjusting orifice 321 formed thereon. The base 3 also includes at least one adjustment shaft 33 inserting through the at least one first adjusting orifice 311 and the at least one second adjusting orifice 321, the at least one adjustment shaft 33 is a screw rod, and the at least one first adjusting orifice 311 is a threaded hole, as shown in FIG. 13, the at least one adjustment shaft 33 is rotated to adjust a distance between the first part 31 and the second part 32 so as to further adjust a distance between the sharpening space A and the oblique gap B.

Thereby, the knife is sharpened by using the sharpening space and the oblique gap so as to form a sharp blade tip, and the knife cannot be sharpened excessively to prevent decreasing a service life of the knife. Furthermore, the knife is sharpened easily and precisely.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A knife sharpening device comprising: a main whetstone portion and a sub whetstone portion;

the main whetstone portion including a bevel seat, two stopping protrusions, at least one first support piece, at least one second support piece, and a main sharpening block; the bevel seat being triangularly formed on a bottom end of the main whetstone portion and having a tilted face defined thereon, and the bevel seat also having the at least one first support piece and the at least one second support piece which are mounted on a first side of the bevel seat proximate to a lower side of the tilted face, wherein the at least one first support piece is higher than the at least one second support piece, the bevel seat further has the main sharpening block accommodated thereon, wherein one side surface of the main sharpening block contacts with the at least one first support piece and the at least one second support piece, the bevel seat further has the sub whetstone portion secured on a second side thereof proximate to a higher side of the tilted face;

the sub whetstone portion including at least one sub sharpening block, an auxiliary sharpening face, and a concave wall; each sub sharpening block having the auxiliary sharpening face defined on a front surface thereof and corresponding to the main sharpening block of the main whetstone portion, the concave wall beings defined below the auxiliary sharpening face;

thereby, the main whetstone portion and the sub whetstone portion are disposed on a base, and a higher side of the bottom end of the main sharpening block contacts with the concave wall and is over the auxiliary sharpening face, hence a sharpening space is defined between the main sharpening block and each sub sharpening block, and between the main sharpening block and the concave wall is defined an oblique gap which extends toward a bottom end of each sub sharpening block.

2. The knife sharpening device as, claimed in claim 1, wherein the two stopping protrusions are disposed on two opposite sides of the bevel seat.

3. The knife sharpening device as claimed in claim 1, wherein the main sharpening block of the main whetstone portion has a first sharpening face and a second sharpening face, the first sharpening face and the second sharpening face have whetstone numbers which are different.

4. The knife sharpening device as claimed in claim 1, wherein each of the at least one first support piece has a first rib formed on a back surface thereof, and each of the at least one second support piece has a second rib formed on a back surface thereof, each sub sharpening block further has a third rib formed on the back surface thereof.

5. The knife sharpening device as claimed in claim 1, wherein the auxiliary sharpening face of the sub whetstone portion is a whetstone surface.

6. The knife sharpening device as claimed in claim 1, wherein the concave wall becomes concaved inwardly from the auxiliary sharpening face so as to match with a tilted angle of the main sharpening block.

7. The knife sharpening device as claimed in claim 1, wherein each sub sharpening block also has the recess formed on an edge of a back surface thereof and in a V shape, and the recess has the notch defined on a bottom end thereof and a predetermined angle slanting upwardly, the recess also has a micro-sharpening face arranged on an upper side of an inner wall thereof.

8. The knife sharpening device as claimed in claim 1, wherein a minimum distance of the sharpening space is 1.1 mm.

9. The knife sharpening device as claimed in claim 1, wherein the bevel seat, the two stopping protrusions, the at least one first support piece, the at least one second support piece, and the at least one sub sharpening block of the sub whetstone portion are one piece formed with the base.

10. The knife sharpening device as claimed in claim 1, wherein the base includes a first part and a second part, and the first part has the main whetstone portion disposed thereon, the second part has the sub whetstone portion mounted thereon, the first part has at least one first adjusting orifice defined thereon and corresponding to the second part, the second part has at least one second adjusting orifice formed thereon; the base also includes at least one adjustment shaft inserting through the at least one first adjusting orifice and the at least one second adjusting orifice, the at least one adjustment shaft is a screw rod, and the at least one first adjusting orifice is a threaded hole, the at least one adjustment shaft is rotated to adjust a distance between the first part and the second part so as to further adjust a distance between the sharpening space and the oblique gap.

* * * * *